US011615927B2

(12) United States Patent
Sugiyama et al.

(10) Patent No.: US 11,615,927 B2
(45) Date of Patent: Mar. 28, 2023

(54) PUSH OPERATION SWITCH

(71) Applicant: OMRON Corporation, Kyoto (JP)

(72) Inventors: Kohei Sugiyama, Kyoto (JP); Kazushi Maeta, Kyoto (JP); Yohei Tsukanaka, Kyoto (JP); Taiki Koyama, Kyoto (JP)

(73) Assignee: OMRON CORPORATION, Kyoto (JP)

( * ) Notice: Subject to any disclaimer, the term of this patent is extended or adjusted under 35 U.S.C. 154(b) by 0 days.

(21) Appl. No.: 17/572,680

(22) Filed: Jan. 11, 2022

(65) Prior Publication Data

US 2022/0293357 A1 Sep. 15, 2022

(30) Foreign Application Priority Data

Mar. 10, 2021 (JP) ..... JP2021-038482

(51) Int. Cl.
*H01H 13/14* (2006.01)
*H01H 1/14* (2006.01)
*H01H 13/20* (2006.01)

(52) U.S. Cl.
CPC ..... *H01H 13/14* (2013.01); *H01H 1/14* (2013.01); *H01H 13/20* (2013.01)

(58) Field of Classification Search
CPC ..... H01H 13/14; H01H 1/14; H01H 13/20; H01H 1/18; H01H 1/22; H01H 1/36; H01H 3/02; H01H 3/12; H01H 3/32; H01H 3/38; H01H 2201/004; H01H 2221/024; H01H 13/60
See application file for complete search history.

(56) References Cited

U.S. PATENT DOCUMENTS 8,809,712 B2 * 8/2014 Kobayashi ..... H01H 9/06 200/306
10,770,245 B2 * 9/2020 Koyama ..... H01H 13/14

FOREIGN PATENT DOCUMENTS

JP 2015-99645 A 5/2015

* cited by examiner

*Primary Examiner* — Lheiren Mae A Caroc
(74) *Attorney, Agent, or Firm* — Metrolex IP Law Group, PLLC

(57) ABSTRACT

A switch may include: a movable member comprising a movable piece extending from a swing shaft and being swingable around the swing shaft; and a pressing member configured to press the movable piece while moving in response to a pushing operation, the movable piece swinging in response to pressing from the pressing member. The pressing member comprises a first contact portion configured to slide along an extending direction of the movable piece in a state of being in contact with the movable piece due to movement by the pushing operation, and a second contact portion configured to be in contact with the movable piece at a position different from a position where the first contact portion is in contact, due to the movement by the pushing operation, and the pressing member presses the movable piece by the first contact portion and the second contact portion in a contact state.

8 Claims, 9 Drawing Sheets

PUSH OPERATION SWITCH

CROSS-REFERENCE TO RELATED APPLICATION

This application is based on Japanese Patent Application No. 2021-038482 filed with the Japan Patent Office on Mar. 10, 2021, the entire contents of which are incorporated herein by reference.

FIELD

The present disclosure relates to a switch that functions in response to a pushing operation.

BACKGROUND

As a switch for controlling the operation of an electric tool, a trigger switch that opens and closes a circuit in response to a pushing operation is widely used. For example, Japanese Unexamined Patent Publication No. 2015-099645 discloses a trigger switch provided with a movable contact piece that rotates like a seesaw.

FIG. 10 is a schematic view illustrating the inside of a conventional trigger switch. FIG. 10 illustrates a conventional trigger switch of the type disclosed in Japanese Unexamined Patent Publication No. 2015-099645. A conventional trigger switch PA1 illustrated in FIG. 10 includes a movable contact piece PA2 that rotates like a seesaw, and a push-button PA3 that presses the movable contact piece PA2 while moving in response to a pushing operation. In the trigger switch PA1 of FIG. 10, when the trigger receives the pushing operation, the push-button PA3 slides in a direction orthogonal to the pressing direction while pressing the sliding surface of the movable contact piece PA2, and rotates the movable contact piece PA2 in a seesaw shape.

However, the conventional trigger switch of the type described in Japanese Unexamined Patent Publication No. 2015-099645 has a problem that an operation load becomes large because the push-button PA3 slides on the movable contact piece PA2 in accordance with the pushing operation while pressing the movable contact piece PA2 in a direction orthogonal to the direction of the movement by the pushing operation of a trigger.

SUMMARY

A switch according to one or more embodiments may be capable of reducing an operation load.

A switch according to one or more embodiments may include: a movable member in which a movable piece extending from a swing shaft is swingable around the swing shaft; and a pressing member configured to press the movable piece while moving in response to a pushing operation, the movable piece being a switch that swings in response to pressing from the pressing member. The pressing member includes a first contact portion configured to slide along an extending direction of the movable piece in a state of being in contact with the movable piece due to movement by the pushing operation, and a second contact portion configured to be in contact with the movable piece at a position different from a position where the first contact portion is in contact, due to the movement by the pushing operation. The pressing member presses the movable piece by the first contact portion and the second contact portion in the contact state.

Further, in a switch, an energizing member, which energizes the first contact portion in a direction substantially orthogonal to a moving direction of the pressing member, may be provided. The first contact portion is energized by the energizing member to press the movable piece in a direction substantially orthogonal to the moving direction of the pressing member, and the second contact portion presses the movable piece in a direction substantially parallel to the moving direction of the pressing member.

Further, in a switch, in a movement process of the pressing member by the pushing operation, a section in which the first contact portion is in contact with the movable piece may be longer than a section in which the second contact portion is in contact with the movable piece.

Further, in a switch, a fixed contact may be provided, the movable member has a movable contact in a vicinity of a tip extending from the swing shaft of the movable piece, and the movable contact may be in contact with and separates from the fixed contact by swinging of the movable piece.

Such a switch according to one or more embodiments may be provided with a pressing member for pressing a movable piece while moving in response to a pushing operation and may be applied to a switch in which the movable piece swings in response to pressing from the pressing member. In the switch according to one or more embodiments, the pressing member may press the movable piece by a first contact portion configured to slide along an extending direction of the movable piece in a state of being in contact with the movable piece due to movement by the pushing operation, and a second contact portion configured to come into contact with the movable piece at a position different from a position where the first contact portion is in contact, due to the movement by the pushing operation. As a result, a switch according to one or more embodiments may have excellent effects such as being able to reduce an operation load.

DETAILED DESCRIPTION

Hereinafter, one or more embodiments will be described with reference to the drawings.

Application Example

A switch according to one or more embodiments are applicable to trigger switches incorporated in various electric devices, including electric tools such as an electric drill, an electric saw, an electric driver, an electric wrench, an electric grinder, and the like, each having a drive unit such as a motor. In the following embodiment, the switch according to one or more embodiments will be described by illustrating g a trigger switch TS incorporated in an electric tool with reference to the drawings.

Embodiment

Configuration Example

Figure 1:
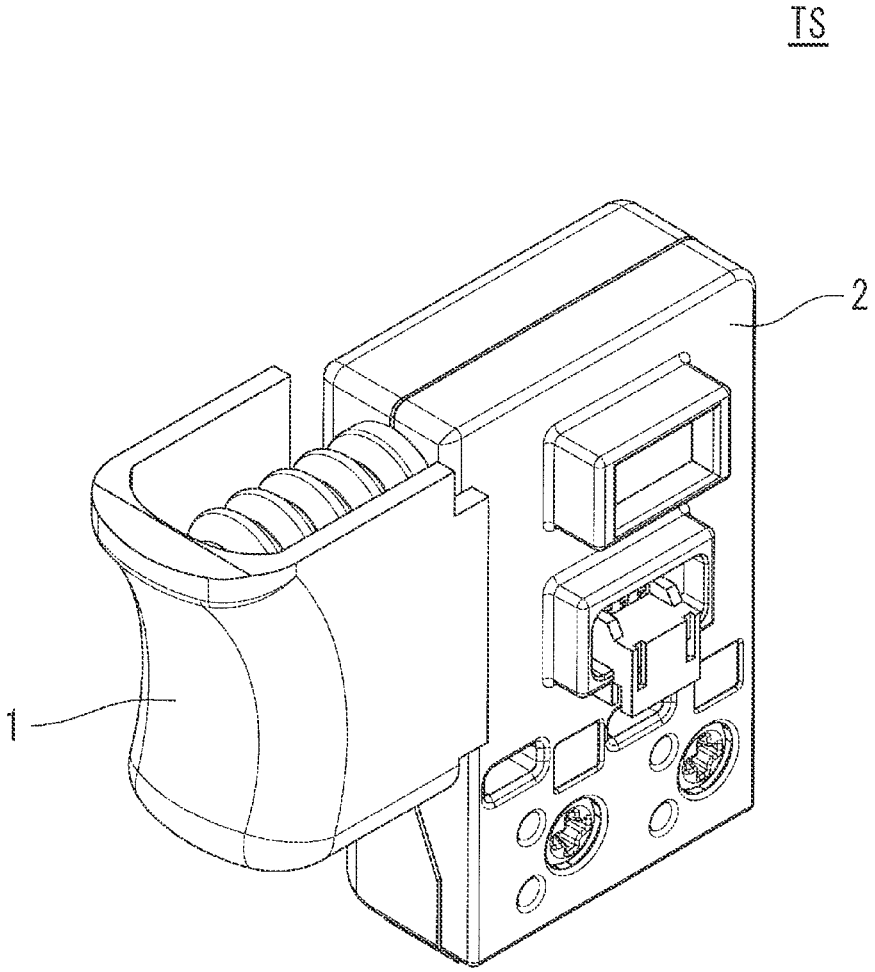
FIG. 1 is a diagram illustrating a schematic perspective view of an example of an appearance of a trigger switch according to one or more embodiments.

FIG. 1 is a schematic perspective view illustrating an example of the appearance of the trigger switch TS according to one or more embodiments. FIG. 1 illustrates the appearance of a trigger switch TS that may be incorporated into various electric devices such as electric tools. The trigger switch TS is a switch operated by an operator of the electric device, and when the operator performs a pushing operation to push a trigger 1 of the trigger switch TS, a drive unit such as an electric motor built in the electric device is driven. The trigger switch TS includes a substantially rectangular parallelepiped housing 2 incorporated in the electric device and the trigger 1 that may be pushed by the operator. The housing 2 is formed by combining two halves.

Figure 2:
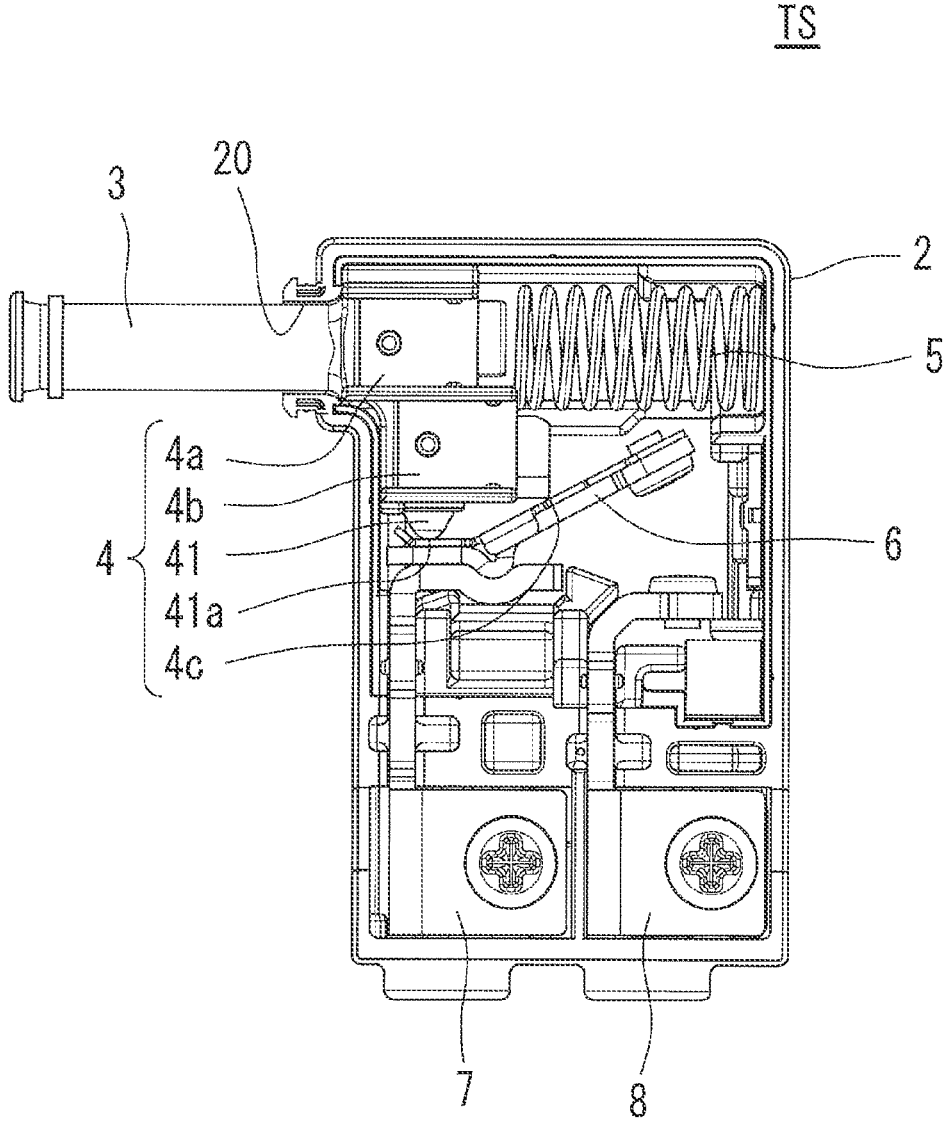
FIG. 2 is a diagram illustrating a schematic side view of an example of a main part of a trigger switch according to one or more embodiments.
Figure 3:
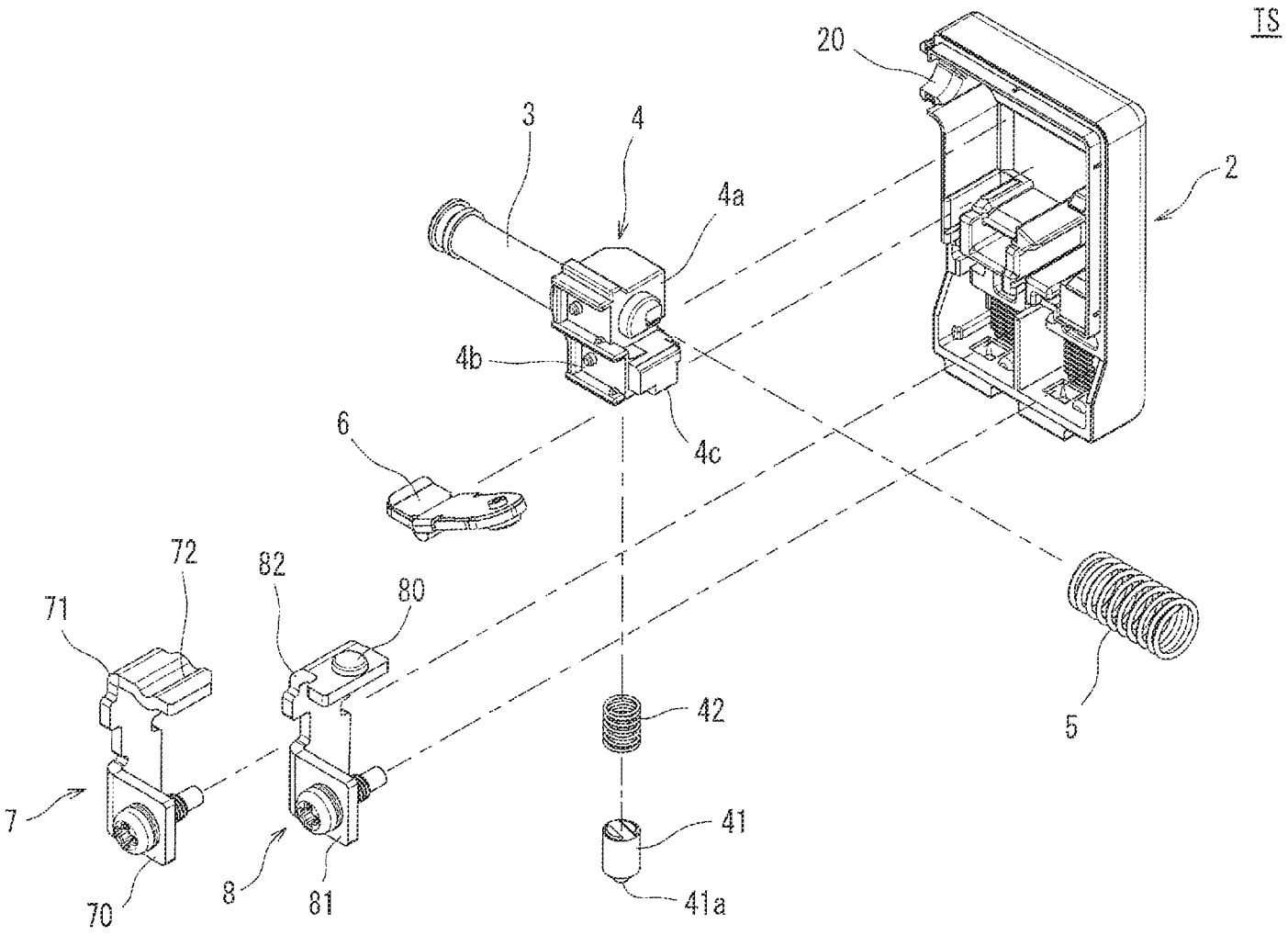
FIG. 3 is a diagram illustrating a schematic exploded view of an example of a main part of a trigger switch according to one or more embodiments.

The internal configuration of the trigger switch TS will be described. FIG. 2 is a schematic side view illustrating an example of the main part of the trigger switch TS according to one or more embodiments. FIG. 3 is a schematic exploded view illustrating an example of the main part of the trigger switch TS according to one or more embodiments. FIGS. 2 and 3 illustrate the trigger switch TS with the trigger 1 and the front half side, in FIG. 2, of the housing 2 removed in order to visually recognize the internal configuration of the trigger switch TS. In the following description, the direction of the trigger switch TS is expressed with the left side as left, the right side as right, the upper side as upper, and the lower side as lower as presented in FIG. 2. However, the above directions relative to the position shown in the figure, as well as other relative direction descriptions herein, are provided for convenience of explanation and do not limit the possible orientation directions of the trigger switch TS in use.

In one or more embodiments, the trigger switch TS may include a shaft member 3, a pressing member 4, a returning member 5, a movable member 6, a first terminal member 7, and a second terminal member 8. A substantially circular through hole 20 is formed on the left side surface of the housing 2, and the shaft member 3 penetrates the inside and outside of the housing 2 through the through hole 20. The pressing member 4, the returning member 5, the movable member 6, the first terminal member 7, and the second terminal member 8 are housed in the housing 2.

The shaft member 3 transmits the pushing operation received by the trigger 1 to the pressing member 4. The shaft member 3 is a substantially rod-shaped plunger disposed substantially horizontally so that the longitudinal direction is the right-left direction as shown in the figure. In the shaft member 3, the radial cross section of a portion of the housing 2 that penetrates the through hole 20 has a substantially circular shape with an outer diameter slightly smaller than the inner diameter of the through hole 20. The trigger 1 illustrated in FIG. 1 is attached to the left end side of the shaft member 3, and the pressing member 4 is attached rightward end side. When the operator performs a pushing operation on the trigger 1, the shaft member 3 moves rightward together with the trigger 1 moving rightward in response to the pushing operation.

Figure 4:
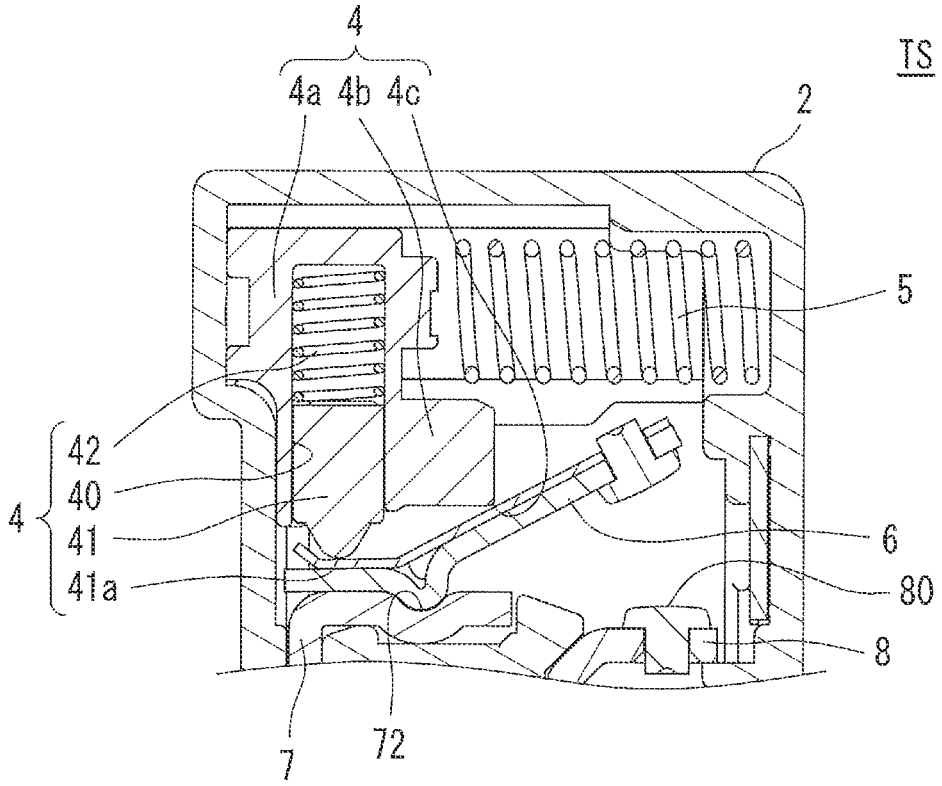
FIG. 4 is a diagram illustrating a schematic side sectional view of an example of cross sections of a pressing member and members around the pressing member provided in a trigger switch according to one or more embodiments.

FIG. 4 is a schematic side sectional view illustrating an example of cross sections of the pressing member 4 and members around the pressing member 4 provided in the trigger switch TS according to one or more embodiments. The pressing member 4 will be described with reference to FIGS. 2 to 4. The pressing member 4 moves together with the shaft member 3 to press the movable member 6.

The outer shape of the pressing member 4 has a shape formed by vertically connecting an upper body 4*a* and a lower body 4*b* in a rectangular parallelepiped shape, and the lower body 4*b* side is shifted rightward with respect to the upper body 4*a*. The pressing member 4 has the left side surface of the upper body 4*a* attached rightward end of the shaft member 3 and moves rightward together with the trigger 1 and the shaft member 3 in response to the pushing operation of the operator. The pressing member 4 presses the movable member 6 disposed below while moving in response to the pushing operation. The returning member 5 including a return spring such as a compression coil spring is disposed on the right side of the upper body 4*a* of the pressing member 4 and energizes the pressing member 4 leftward. When the operator cancels the pushing operation, the returning member 5 presses the trigger 1, the shaft member 3, and the pressing member 4 leftward.

An opening 40 formed in a substantially cylindrical shape extending upward from the surface of the lower end is formed in the pressing member 4. The lower end of the opening 40 is open at the lower end of the pressing member 4, and the upper end of the opening 40 is an inner top surface inside the pressing member 4. A contact member 41 for pressing the movable member 6 and an energizing member 42 for energizing the contact member 41 downward are housed inside the opening 40. The contact member 41 is a pusher having an upper portion of a substantially cylindrical shape and a lower portion of a substantially conical shape and is housed so as to be vertically movable while being guided by the side wall of the opening 40. The lower end of the contact member 41 corresponding to the apex of the cone is in contact with the movable member 6 as a first contact portion 41*a*. The energizing member 42 is formed of a member having an energizing force, such as a compression coil spring. The upper end of the energizing member 42 is in contact with the inner top surface as the upper end of the opening 40, and the lower end of the energizing member 42 is in contact with the upper end of the contact member 41 to energize the contact member 41 downward. The energizing member 42 energizes the contact member 41 having the first contact portion 41*a* downward in a direction substantially orthogonal to the lateral direction, which is the moving direction of the pressing member 4. The first contact portion 41*a* of the contact member 41 is energized by the energizing member 42 to press the movable member 6 downward, which is a direction substantially orthogonal to the right-left direction as the moving direction of the pressing member 4.

The lower right corner side of the lower body 4*b* of the pressing member 4 includes a second contact portion 4*c* that is in contact with the movable member 6 at a position different from a position where the first contact portion 41*a* is in contact. By the pressing member 4 moving rightward side, the second contact portion 4*c* presses the movable member 6 rightward substantially parallel to the moving direction.

The returning member 5 is for returning the pressing member 4, which has moved rightward, to its original position. The returning member 5 includes a return spring such as a compression coil spring and is disposed on the right side of the pressing member 4. The right end of the returning member 5 is in contact with the inner wall of the housing 2, and the left end energizes the pressing member 4 leftward.

Figure 5:
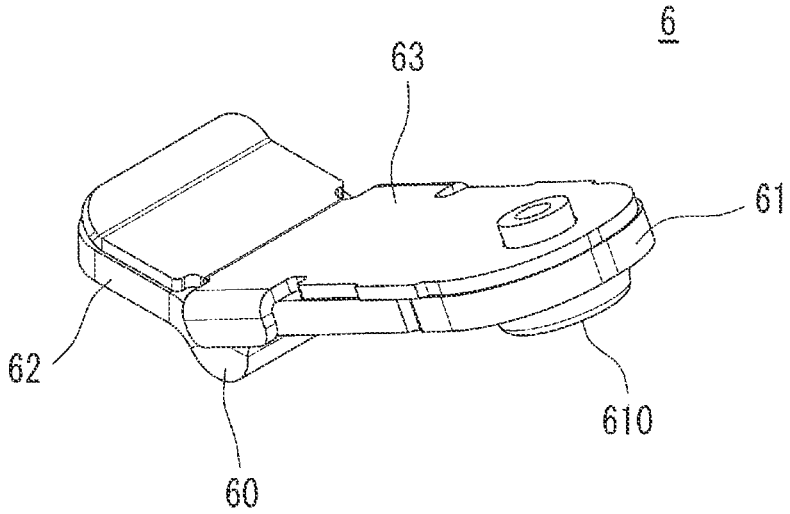
FIG. 5 is a diagram illustrating a schematic perspective view of an example of a movable member provided in a trigger switch according to one or more embodiments.

FIG. 5 is a schematic perspective view illustrating an example of the movable member 6 provided in the trigger switch TS according to one or more embodiments. The movable member 6 will be described with reference to FIGS. 2 to 5. The movable member 6 swings in response to pressure from the pressing member 4 and electrically connects and separates between the first terminal member 7 and the second terminal member 8. The movable member 6 includes a swing shaft 60, a first movable piece 61 extending rightward from the swing shaft 60, and a second movable piece 62 extending leftward from the swing shaft 60. The movable member 6 is formed by bending a conductive metal plate.

The swing shaft 60 is formed by bending a metal plate in an arc shape and is fitted into the first terminal member 7 and supported so as to be swingable. The first movable piece 61 extending rightward from the swing shaft 60 and the second movable piece 62 extending leftward form an obtuse angle on the upper side. A sliding plate 63, which slides in a state where the first contact portion 41*a* of the pressing member 4 is in contact, is attached to the upper surfaces of the first movable piece 61 and the second movable piece 62. The sliding plate 63 is attached to the upper surfaces of the first contact portion 41*a* and the second contact portion 4*c* and is mounted in the portion of the swing shaft 60 so as to extend between the root portion of the upper surface of the first contact portion 41*a* and the root portion of the upper surface of the second contact portion 4*c*. A movable contact 610 is attached to the lower surface in the vicinity of the tip of the first movable piece 61.

When receiving the pushing operation of the trigger 1, the movable member 6 is pressed by the first contact portion 41*a* and the second contact portion 4*c* of the pressing member 4 and swings clockwise with the swing shaft 60 as the swinging center. When the movable member 6 swings clockwise, the first movable piece 61 is lowered, the movable contact 610 comes into contact with a fixed contact 80 attached to the second terminal member 8, and the first terminal member 7 and the second terminal member 8 are conducted.

The first terminal member 7 serves as a terminal for electrically connecting the trigger switch TS to an external circuit. The lower portion of the first terminal member 7 includes the first external terminal 70 connected to an external circuit, and a first internal terminal piece 71 extends upward from the first external terminal 70. The first internal terminal piece 71 extends upward, bends at a substantially right angle in the middle, and extends horizontally rightward. A receiving portion 72 bent in a concave shape to receive the swing shaft 60 of the movable member 6 on the upper surface is formed in the horizontal portion of the first internal terminal piece 71. The first terminal member 7 supports the movable member 6 so as to be swingable by the receiving portion 72.

The second terminal member 8 serves as a terminal for electrically connecting the trigger switch TS to an external circuit. In the second terminal member 8, a lower portion serves as a second external terminal 81 connected to an external circuit, and a second internal terminal piece 82 extends upward from the second external terminal 81. The second internal terminal piece 82 extends upward, bends at a substantially right angle in the middle, and extends horizontally rightward. A fixed contact 80 is attached to the upper surface near the tip of the horizontal portion of the second internal terminal piece 82. The fixed contact 80 comes into contact with and separated from the movable contact 610 of the swinging movable member 6.

Operation Example

Figure 6:
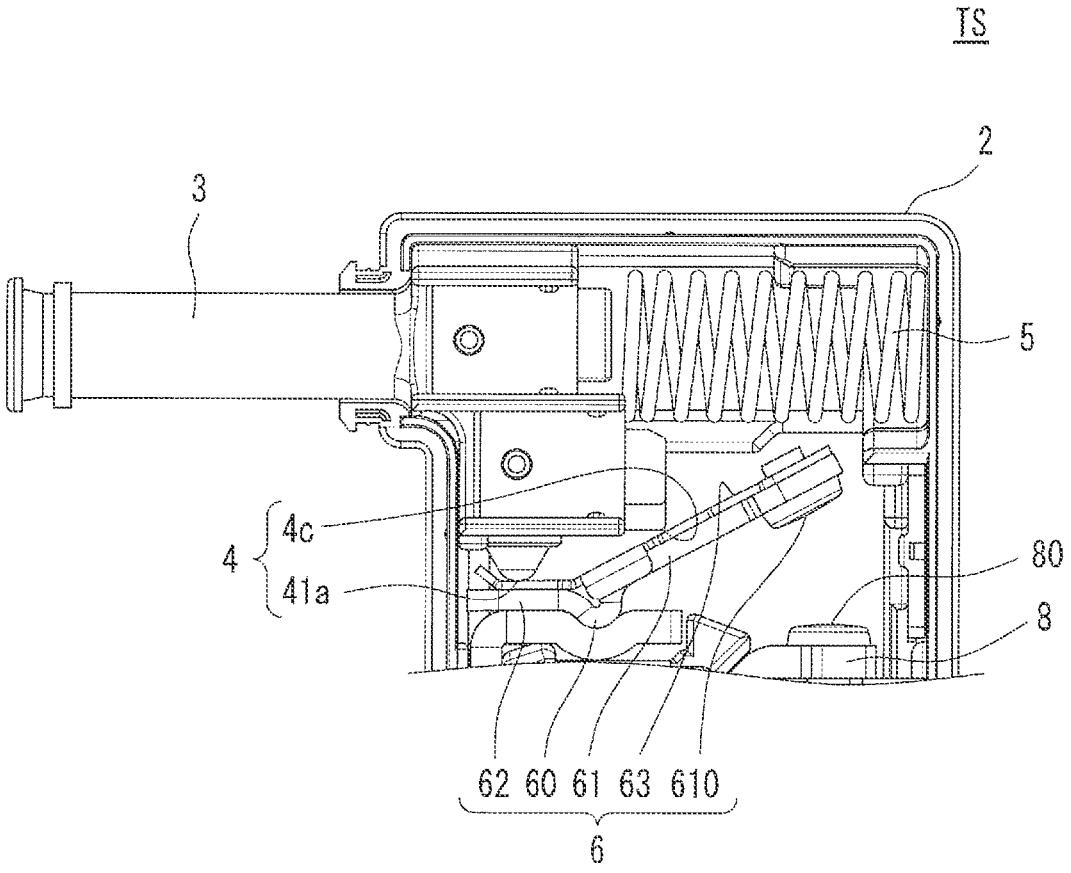
FIG. 6 is a diagram illustrating an enlarged schematic side view of a part of a trigger switch according to one or more embodiments.

The operation of the trigger switch TS according to one or more embodiments configured as described above will be described. FIG. 6 is an enlarged schematic side view illustrating a part of the trigger switch TS according to one or more embodiments. FIG. 6 illustrates an enlarged view of the vicinities of the pressing member 4 and the movable member 6 by removing the trigger 1 and the front half of and the housing 2 of the trigger switch TS. FIG. 6 illustrates a state of a reference position where the pushing operation of the trigger 1 is not received. In the reference position, the extending direction of the second movable piece 62 of the movable member 6 is substantially horizontal, and the extending direction of the first movable piece 61 is substantially diagonally upward to the right. The first contact portion 41*a* of the pressing member 4 is in contact with the sliding plate 63 on the upper surface of the second movable piece 62 of the movable member 6 and presses the second movable piece 62 downward. The second contact portion 4*c* of the pressing member 4 is in contact with the sliding plate 63 on the upper surface of the first movable piece 61 of the movable member 6. The movable contact 610 attached to the first movable piece 61 of the movable member 6 is separated from the fixed contact 80 attached to the second terminal member 8, and the circuit between the first terminal member 7 and the second terminal member 8 is open.

Figure 7:
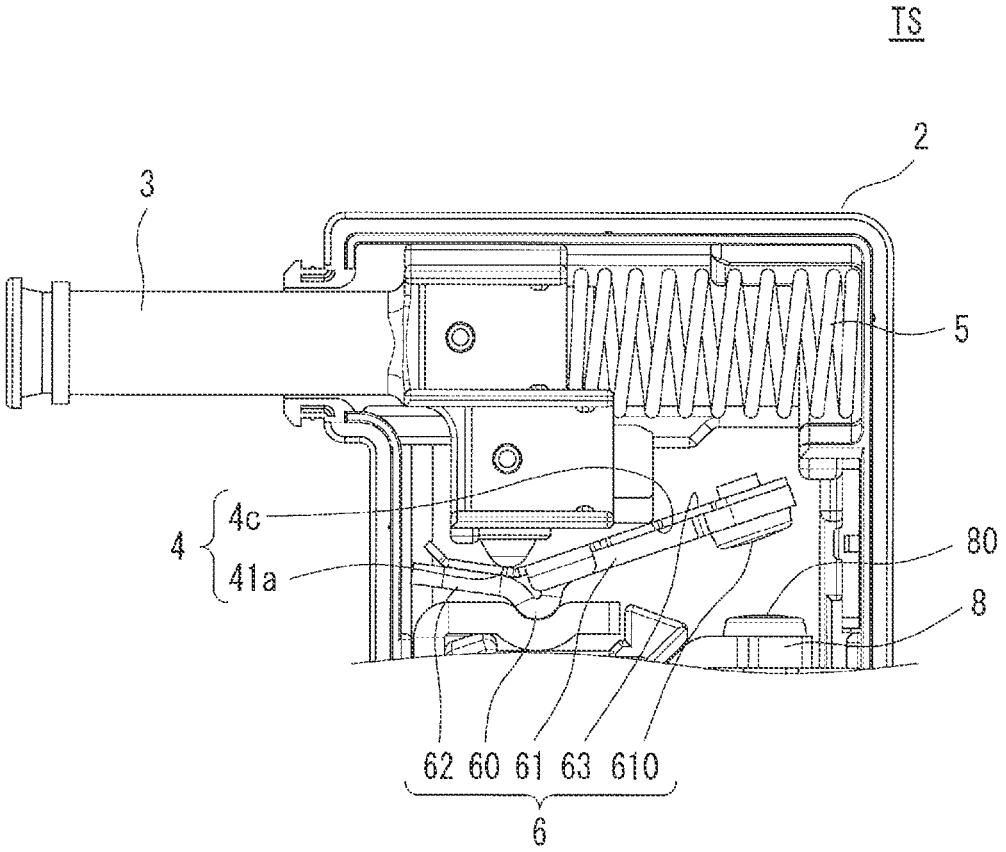
FIG. 7 is a diagram illustrating an enlarged schematic side view of a part of a trigger switch according to one or more embodiments.

FIG. 7 is an enlarged schematic side view illustrating a part of the trigger switch TS according to one or more embodiments. FIG. 7 illustrates a state in which the pushing operation has been performed by the operator from the state illustrated in FIG. 6, and the pressing member 4 has moved rightward together with the trigger 1 and the shaft member 3. With the movement of the pressing member 4 by the pushing operation, the first contact portion 41*a* is in contact with the sliding plate 63 on the first movable piece 61 beyond the swing shaft 60 and presses the first movable piece 61 downward. The movable member 6 is energized in a clockwise swinging direction by the downward pressing from the first contact portion 41*a*. With the movement of the pressing member 4, the second contact portion 4*c* presses the first movable piece 61 rightward. The movable member 6 is energized in the clockwise swinging by the rightward pressing from the second contact portion 4*c*. The pressing by the first contact portion 41*a* is accomplished by the energizing force generated by the energizing member 42 in the direction substantially orthogonal to the moving direction of the pressing member 4. The pressing by the second contact portion 4*c*, in a direction substantially parallel to the direction of the movement of the pressing member 4, is accomplished by the pushing operation, and the force of swinging the movable member 6 clockwise by the pushing operation is easily transmitted to the first movable piece 61 as compared to the first contact portion 41*a*. The movable member 6 pressed by the first contact portion 41*a* and the second contact portion 4*c* from the pressing member 4 starts to swing clockwise.

Figure 8:
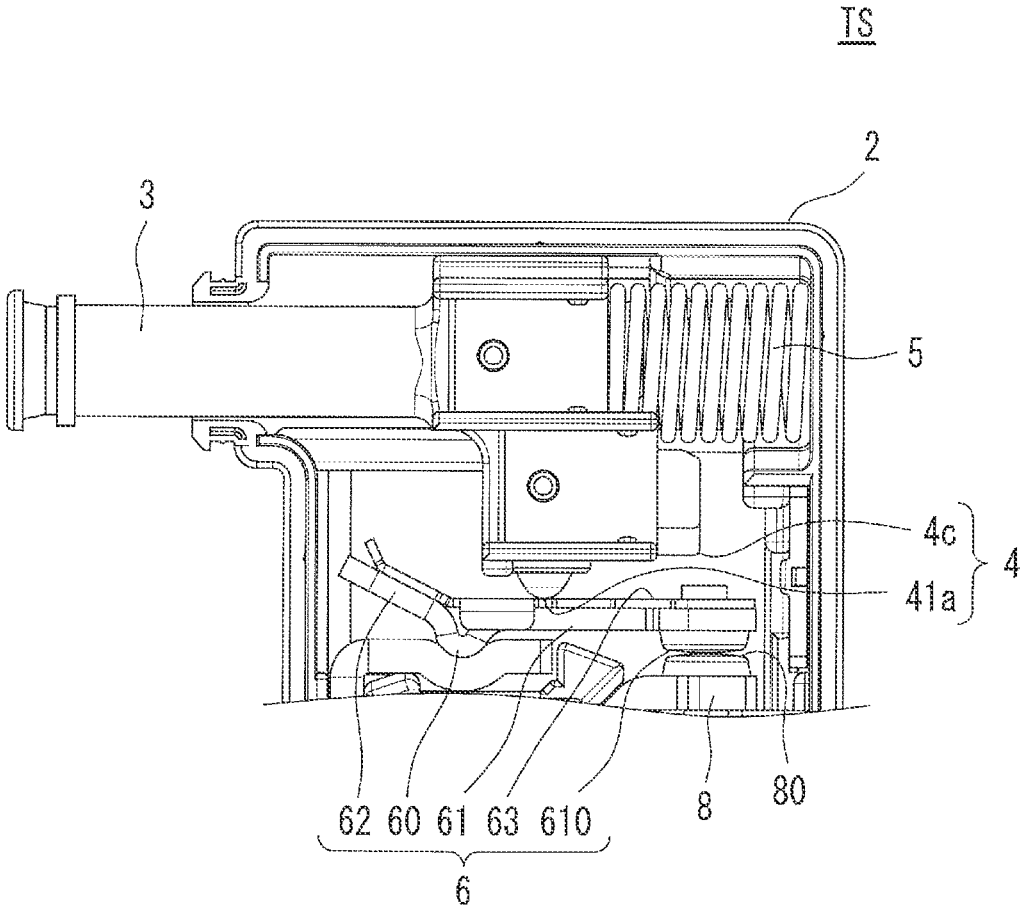
FIG. 8 is a diagram illustrating an enlarged schematic side view of a part of a trigger switch according to one or more embodiments.

FIG. 8 is an enlarged schematic side view illustrating a part of the trigger switch TS according to one or more embodiments. FIG. 8 illustrates a state in which the pushing operation has further been performed from the state illustrated in FIG. 7, and the pressing member 4 has moved rightward together with the trigger 1 and the shaft member 3. FIG. 8 illustrates a state in which the movable member 6 has swung to the limit of the swing range, in which the extending direction of the first movable piece 61 is substantially horizontal and the extending direction of the second movable piece 62 is substantially diagonally upward to the left. With the movement of the pressing member 4 by the pushing operation, the first contact portion 41*a* slides along the extending direction of the first movable piece 61 in a state of being in contact with the first movable piece 61 and presses the first movable piece 61 downward. When the movable member 6 swings at a predetermined angle or more, the second contact portion 4*c* is separated from the first movable piece 61. The movable contact 610 attached to the first movable piece 61 of the movable member 6 is in contact with the fixed contact 80 attached to the second terminal member 8, and the circuit between the first terminal member 7 and the second terminal member 8 is closed.

When the operator cancels the pushing operation from the state illustrated in FIG. 8, the pressing member 4 is energized by the returning member 5 to move leftward and returns to the reference position illustrated in FIG. 6.

Mechanical Effects

Figure 9A:
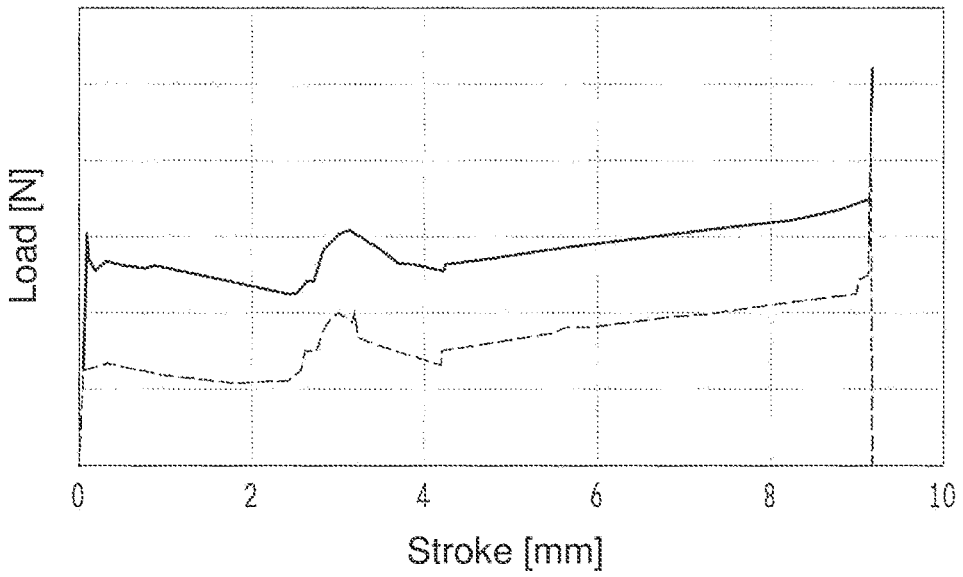
FIG. 9A is a graph illustrating a mechanical relationship concerning a trigger switch.
Figure 9B:
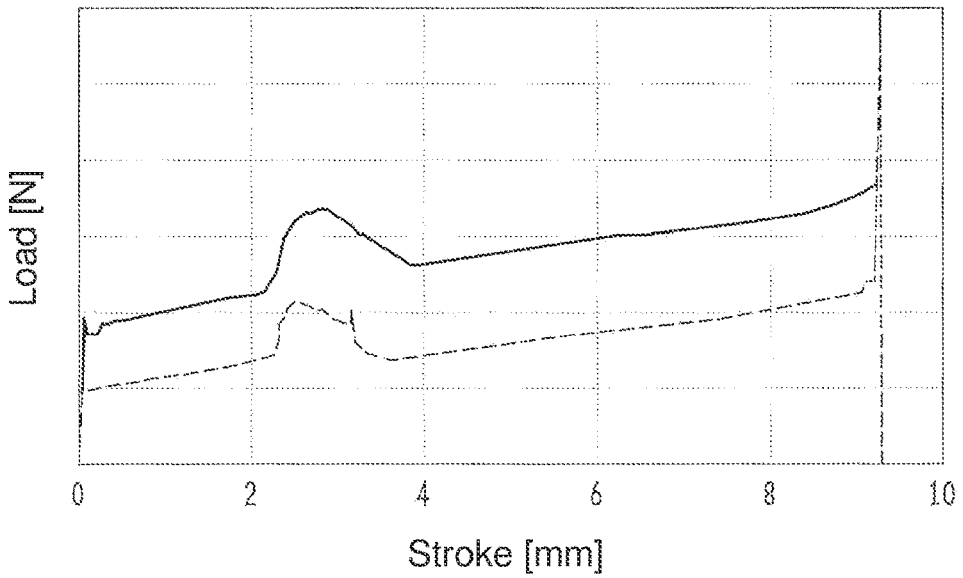
FIG. 9B is a graph illustrating a mechanical relationship concerning a trigger switch.
Figure 10:
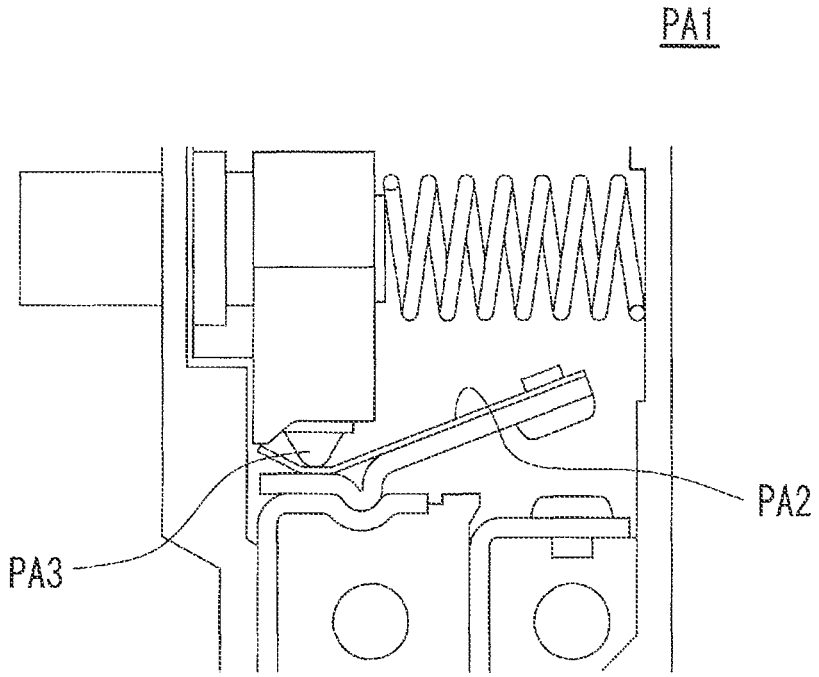
FIG. 10 PRIOR ART
FIG. 10 is a schematic diagram illustrating an inside of a conventional trigger switch.

FIGS. 9A and 9B are graphs each illustrating a mechanical relationship concerning the trigger switch TS. FIG. 9A illustrates the mechanical relationship concerning the trigger switch TS according to one or more embodiments in which the movable member 6 is pressed by the first contact portion 41*a* and the second contact portion 4*c*. FIG. 9B illustrates, for comparison, the mechanical relationship concerning the trigger switch PA1 of the conventional type illustrated in FIG. 10 for pressing the movable contact piece PA2 (corresponding to the movable member 6) only by the push-button PA3 (corresponding to the first contact portion 41*a*). In FIGS. 9A and 9B, the horizontal axis indicates the length of the stroke (pushing amount) of the trigger 1, and the vertical axis indicates the load required for the operation. The solid line illustrates the relationship between the stroke and the load when the trigger 1 is pushed in, and the dotted line illustrates the relationship between the stroke and the load when the trigger 1 is returned.

In the process of the pushing operation, from the start of the pushing operation until the stroke reaches a predetermined length, the movable member 6 is pressed by the second contact portion 4*c* in addition to the first contact portion 41*a*, so that the load becomes larger than when the movable member 6 is pressed only by the first contact portion 41*a*. However, since the force by the pushing operation is easily transmitted to the first movable piece 61 in the second contact portion 4*c*, the maximum value of the load is reduced at the peak portion of the load generated during the pushing operation. In other words, in the movement process of the pressing member 4 by the pushing operation, the first contact portion 41*a* is constantly in contact with the first movable piece 61 or the second movable piece 62, and the second contact portion 4*c* is in contact with the first movable piece 61 from the start of the pushing operation until the stroke reaches a predetermined length. That is, in the movement process of the pressing member by the pushing operation, the section where the first contact portion 41*a* is in contact with the first movable piece 61 or the second movable piece 62 is longer than the section where the second contact portion 4*c* is in contact with the first movable piece 61. The first contact portion 41*a* constantly presses the movable member 6 downward, but in a section where it is difficult to apply a force for swinging the movable member 6, the second contact portion 4*c* presses the movable member 6 rightward in addition to the first contact portion 41*a*, so that the movable member 6 may be swung with a small force.

As described above, in the trigger switch TS according to one or more embodiments, the pressing member 4 presses the movable piece (first movable piece 61, second movable piece 62) by the first contact portion 41*a* that slides along the extending direction of the movable piece (first movable piece 61, second movable piece 62) in a state of being in contact with the movable piece (first movable piece 61, second movable piece 62) due to the movement by the pushing operation, and the second contact portion 4*c* that is in contact with the movable piece (first movable piece 61) at a position different from a position where the first contact portion 41*a* is in contact. As a result, the trigger switch TS according to one or more embodiments has excellent effects such as being able to reduce the peak of the operation load in the pushing operation process. In particular, in the case of the trigger switch TS with the second contact portion 4*c* designed to press the movable piece (first movable piece 61) in a direction substantially parallel to the moving direction of the pressing member 4, the pressing by the second contact portion 4*c* becomes the pressing in a direction substantially parallel to the direction of the movement of the pressing member 4 by the pushing operation, and the force for swinging the movable member 6 clockwise by the pushing operation is more easily transmitted to the movable piece (first movable piece 61) than the first contact portion 41*a*. Therefore, the trigger switch TS according to one or more embodiments has excellent effects such as being able to further reduce the peak of the operation load in the pushing operation process.

The invention may not be limited to the above description, but may be implemented in various other forms. Thus, the above-described one or more embodiments are merely exemplary in all respects and should not be considered exhaustive. The technical scope of the invention is defined by the claims and is not considered restricted by the description in the specification. Moreover, embodiments or modifications that fall within the scope of equivalency of the claims, are considered to be within the scope of the invention.

For example, although one or more embodiments are disclosed that may be applied to a trigger switch TS incorporated in an electric tool, as has been illustrated in the figures, the invention may not be considered to be t limited thereto but may be applied to various switches having a seesaw-shaped movable member 6.

Further, for example, although the movable member 6 having the first movable piece 61 and the second movable piece 62 has been illustrated and described, embodiments may not be considered to be restricted thereto but may encompass forms such as using the movable member 6 in which the movable piece 61 extends from the swing shaft 60 to only one side.

The invention claimed is:

1. A switch comprising:

a movable member comprising:

a movable piece extending from a swing shaft and being swingable around the swing shaft; and a pressing member configured to press the movable piece while moving in response to a pushing operation, the movable piece swinging in response to pressing from the pressing member, wherein the pressing member comprises a first contact portion configured to slide along an extending direction of the movable piece in a state of being in contact with the movable piece due to movement by the pushing operation, and a second contact portion configured to be in contact with the movable piece at a position different from a position where the first contact portion is in contact, due to the movement by the pushing operation, and the pressing member presses the movable piece by the first contact portion and the second contact portion in a contact state.

2. The switch according to claim 1, further comprising an energizing member configured to energize the first contact portion in a direction substantially orthogonal to a moving direction of the pressing member, wherein the first contact portion is energized by the energizing member to press the movable piece in a direction substantially orthogonal to the moving direction of the pressing member, and the second contact portion presses the movable piece in a direction substantially parallel to the moving direction of the pressing member.

3. The switch according to claim 2, wherein, in a movement process of the pressing member by the pushing operation, a section in which the first contact portion is in contact with the movable piece is longer than a section in which the second contact portion is in contact with the movable piece.

4. The switch according to claim 3, further comprising a fixed contact, wherein the movable member has a movable contact in a vicinity of a tip extending from the swing shaft of the movable piece, and the movable contact is in contact with and separates from the fixed contact by swinging of the movable piece.

5. The switch according to claim 2, further comprising a fixed contact, wherein the movable member has a movable contact in a vicinity of a tip extending from the swing shaft of the movable piece, and the movable contact is in contact with and separates from the fixed contact by swinging of the movable piece.

6. The switch according to claim 1, wherein in a movement process of the pressing member by the pushing operation, a section in which the first contact portion is in contact with the movable piece is longer than a section in which the second contact portion is in contact with the movable piece.

7. The switch according to claim 6, further comprising a fixed contact, wherein the movable member has a movable contact in a vicinity of a tip extending from the swing shaft of the movable piece, and the movable contact is in contact with and separates from the fixed contact by swinging of the movable piece.

8. The switch according to claim 1, further comprising a fixed contact, wherein the movable member has a movable contact in a vicinity of a tip extending from the swing shaft of the movable piece, and the movable contact is in contact with and separates from the fixed contact by swinging of the movable piece.

* * * * *